United States Patent [19]

Siegler et al.

[11] Patent Number: 4,740,211

[45] Date of Patent: Apr. 26, 1988

[54] CHROMIUM-FREE TANNING PROCESS

[75] Inventors: Marcel Siegler, North Bergen; Ernest Diamont, Fanwood; Joseph L. Suarez, Wayne; Colin D. Quinn, Old Bridge, all of N.J.

[73] Assignee: Seton Company, Inc., Newark, N.J.

[21] Appl. No.: 776,023

[22] Filed: Sep. 9, 1985

[51] Int. Cl.[4] ..... C14C 3/08; C14C 3/10

[52] U.S. Cl. ..... 8/94.33; 8/94.32; 8/94.19 R

[58] Field of Search ..... 8/94.19 R, 94.26, 94.28, 8/94.24, 94.29, 94.3, 94.32, 94.33; 36/83

[56] References Cited

U.S. PATENT DOCUMENTS 3,212,996 10/1965 Simmons ..... 8/94.19 R 4,060,384 11/1977 Siegler ..... 8/94.19

*Primary Examiner*—Paul Lieberman

*Assistant Examiner*—John F. McNally

*Attorney, Agent, or Firm*—Webb, Burden, Robinson & Webb

[57] ABSTRACT

The present process yields superior leather materials from limed hides, without the use of chromium salts, by combining a series of essential method steps in a sequence which yields leather having a "chrome" character. The present chromium-free tanning process includes the method steps of pretanning a hide with a chromium-free tan until its shrinkage temperature is about 170° to 185° F., submerging the hide in an acidic brine, having a pH between 2.5 and 3.5, and adding (in sequence, and in amounts sufficient to yield specified concentrations of each) pretanning agents, syntans, vegetable extracts, neutralizing agents and retanning and finishing agents, all of which are free from chromium. This method of pretanning, tanning and retanning a hide with a specified sequence of particular concentrations of chromium-free reagents yields a leather product having the characteristics of chrome-tanned leather and which demonstrates superior shrink resistance, resilience and flexural strength. The resultant leather product has particular utility when incorporated into durable, weather-resistant footwear such as military boots and shoes.

10 Claims, No Drawings

CHROMIUM-FREE TANNING PROCESS

FIELD OF THE INVENTION

The present invention relates to leather tanning methods and more specifically pertains to a combination tanning process which, although it incorporates only chromium-free agents, yields leather having the properties and advantages charcteristic of chrome-tanned leather.

BACKGROUND OF THE INVENTION

The leather tanning art has a history which spans thousands of years. Leather is produced by treating a hide or skin with one or more tanning agents; the tanning process prevents degradation and putrefaction and also prevents the leather from drying into a stiff, boardy product. Many varied tanning agents are known in the art, and each different type provides certain advantages and yields leather having distinct characteristics.

Of the various tanning agents available, mineral tanning agents traditionally have been preferrred, in lieu of vegteble-tanning agents, in the preparation of strong leathers having good volume and flexural strength. Of the mineral tanning agents, aqueous solutions of basic salts of chromium have been universally accepted and consistently preferred over other mineral tanning agents, such as the basic salts of zirconium and aluminum, because these "chrome-tanning" agents consistently yield superior products. Unfortunately, chrome-tanning agents also yield pollutant chrome-tanning effluents, which are undesirable for environmental reasons. The chromium containing effluents result from the disposeal of shavings and leachings from dumped shavings and, of course, from the disposal of the chrome-tanning liquors.

Because chromium recovery or recycling of the spent chrome is not always as effective as expected, the leather industry has long needed a chromium-free tanning composition to eliminate the environmental difficulties associated with chrome-tanning agents. Furthermore, the rapidly rising costs of labor and heavy chemicals and the dependence of the United States on foreign sources of chromium ore also create a need for leather-tanning methods which yield products comparable to those tanned with chrome-tanning agents, without the use of chromium salts.

Certain chromium-free tanning agents are known in the art. These tanning agents, however, do not yield leather having a "chrome" character, but instead yield leathers which are alternately softer, stretchier, weaker, thinner or more papery than chrome leathers.

The best known chromium-free tanning agents are the vegetable tans. Vegetable tans are aqueous extracts from plant leaves, barks, etc., to yield aqueous solutions or suspensions of large polyphenol molules with some acidic groups and high secondary valency potentials (dipole hydrogen bonds). The acidic groups may combine with the basic groups of the hide protein to displace the water of hydration with a sheath of vegetable tan molecules. Upon drying of the hide, these vegetable tan molecules prevent shrinking and undue crosslinking of the hide and yield a preserved, but not stiff, leather product. High quantities of vegetable tans must be incorporated into leather to give it firmness and flexural strength.

Many synthetic tanning agents, or syntans, are also well-known chromium-free tanning compositions. Although syntans may differ widely in actual chemical composition, syntans resemble vegetable tans in that they usually have a strong ionic charge and thus are strongly attracted to complementary ionic groups on the protein molecules in the hide. In the same general manner as the vegetable tans, therefore, the syntans dehydrate and preserve the leather without permitting it to shrink into a stiff, boardy product.

Tanning agents containing the basic salts of zirconium and aluminum function in a manner similar to chrome-tanning agents, but do so without chrome. Unfortunately, these zirconium and aluminum tanning agents cannot produce leather characteristic of the chrome-tanning process, but instead yield products which shrink more readily upon immersion in boiling water or during storage and which lack the smooth, flat, flexible grain and resilient feel of chrome-tanned leather. In addition, these tanning processes are frequently even more complicated, time-consuming and expensive than the chrome-tanning processes which they replace.

The various types of tanning agents have been combined, on occasion, to give "combination tanned" leathers. Neither the known chromium-free combination tanning processes nor the individual chromium-free tanning agents themselves have over produced a leather product having the superior characteristics of chrome-tanned leather. Accordingly, the need persists for a chromium-free tanning process which, without the use of chromium salts, yields a leather demonstrating the various advantages characteristic of chrome-tanned hides and skins. More particularly, the need persists for a chromium-free tanning process suitable for tanning hides for use in strong, durable and weather-resistant footwear such as military shoes and boots.

BRIEF DESCRIPTION OF THE INVENTION

The present process yields superior leather materials from lined hides, without the use of chromium salts, by combining a series of essential method steps in a sequence which yields leather having a "chrome" character. The present chromium-free tanning process includes the method steps of pretanning a hide with a chromium-free tan until its shrinkage temperature is about 170° to 185° F., submerging the hide in an acidic brine, having a pH between 2.5 and 3.5, and adding (in sequence, and in amounts sufficient to yield specified concentrations of each) pretanning agents, syntans, vegetable extracts, neutralizing agents, and retanning and finishing agents, all of which are free from chromium. This method of pretanning, tanning and retanning a hide with a specified sequence of particular concentrations of chromium-free reagents yields a leather product having the characteristics of chrome-tanned leather and which demonstrates superior shrink resistance, resilience and flexural strength. The resultant leather product has particular utility when incorporated into durable, weather-resistant footwear such as military boots and shoes.

DETAILED DESCRIPTION OF THE INVENTION

The present chromium-free tanning process includes the three major phases of pretanning, tanning and retanning a limed hide (such as a cattle hide). Each of these three phases is described in detail below. Unless otherwise specified, "water" refers to tap water and all percentages designate percentage by weight.

The pretanning phase of the present process may be any one of the various processes described in U.S. Pat. No. 4,060,384 to Siegler, entitled "Manufacture of Leather," incorporated herein by reference. The pretanning of the present invention is normally effected on cattle hides or the like after liming, dehairing and bating. The pretanning phase, along with its associated washings and the like, can be carried out on a charge of hides in a single container, without requiring the removal of the hides from the container until the pretanning and tanning is complete. The hides may be pickled before or during pretanning, while the hides are in the container, and such pickling with or without the pretanning places the hides in condition for shipment to remote geographic locations requiring many weeks on route, without danger of material deterioration. Hides pickled and pretanned are preferably wrapped in waterproof plastic sheeting for such shipment to keep them from drying out.

The pretanning process, although it may vary among the processes described in U.S. Pat. No. 4,060,384 and the additional process disclosed below, must yield a pretanned hide which has a shrinkage temperature of between about 170° and 185° F.

The pretanning phase may proceed as follows. Prefleshed, brine-cured heavy steer and cow hides, already limed, soaked, dehaired and, if necessary, lime split, are weighed so that the pretanning agents may be added in amounts calculated based upon the weight of the hides. The hides are then bated in a 4×8 foot rotatable wood hide-treating tumbling drum with bating liquors known in the art. (Other agitating means known in the art may be substituted for the rotatable drum.) The bating liquor is drained, and the hides are washed for between about 10 and 20 minutes with a stream of 80° F. water flowing into the drum at 100 gallons/minute, without removing the hides from the drum. After washing is complete, the drum is drained to leave just enough water to allow the hides to float and 2 to 4% by hide weight ammonium sulphate is added to the drum, and preferably about 3% by hide weight. Also added is 0.06 to 0.08% by hide weight Oropon WN-4, and preferably about 0.07% by hide weight Oropon WN-4. Oropon WN-4 is the trade name of a product which contains pancreatic proteolytic enzymes and which is available from Rohm & Haas. Other preparations of pancreatic proteolytic enzymes can be substituted in enzymatic equivalent amounts. After dissolution of the ammonium sulphate and the Oropon WN-4, the drum is rotated for about 45 minutes to 1 hour.

The drum is then stopped and the pH of the pretanning liquor is checked. If necessary, additional ammonium sulphate or organic acid (lactic acid, formic acid, acetic acid, etc.) is added to bring the liquor pH to between 8.4 and 8.9, and preferably to about 8.5. The drum is again rotated, this time for about 5 minutes out of every 15 minutes for the next half hour. The hides are then washed with 75° F. water for about 30 minutes and, after washing, the hides are again covered in water.

To the water is added 1.0 to 1.5%, and preferably 1.25%, by hide weight of an acrylic polymeric syntan containing 56% syntan solids. A commercially available polymeric syntan suitable for use is Leukotan 1042 (Rohm & Hass) which contains 56% acrylic syntan solids. If desired, either phenol or naphthalene based syntans-or acrylic syntans having more or less than 56% syntan solids-may be substituted for the Leukotan 1042 in tanning equivalent amounts. The drum is then rotated for about 30 minutes, after which 4.5 to 5.5% by hide weight salt (sodium chloride) is added, preferably 5% by hide weight sodium chloride. The drum is rotated for about 5 more minutes. Additonal sodium chloride is then added, if necessary, to yield a Salimeter reading of between about 27 and 29, and preferably a Salimeter reading of 28. Thereafter 1.4 to 1.6%, and preferably 1.5%, sulfuric acid by hide weight and 15% by hide weight water are added to the pretanning liquor to yield an overall pH between 2.0 to 2.2. After the addition of the sulfuric acid, the hide stock may remain in the pretanning liquor overnight, or pretanning may proceed to completion.

To continue the pretanning process, the hides are drummed (i.e., rotated in the drum) for about 5 minutes. After about 5 minutes of drum rotation, about 0.7 to 0.8%, and preferably 0.75% by hide weight, sodium formate is added to the pretanning liquor to yield a liquor pH of between 2.5 and 2.8 (preferably 2.7). The drum is rotated for about 15 minutes more. Ninety percent of the hide stock should, at this point, have a pH between 2.7 and 3.0 and, after about 1 hour of additional tumbling in the sodium formate, the pH of the hide stock should be between about 3.5 and 3.8, with a liquor pH of about 3.1 to 3.3.

To the pretanning liquor is then added 2.4 to 3.6% (preferably 3.5%) by hide weight of the pretanning agent Chromesaver TM A-31 and 0.0155 to 0.0165% (preferably 0.016%) by hide weight Busan 30, along with 0.16% byhide weight water. Busan 30 is the trade name for a broad-spectrum microbiocide available from Buckman Laboratories. Equivalent broad-spectrum microbiocides may be substituted in equivalent amounts. Chromesaver TM A-31 designates a clear, colorless liquid composition containing the various pretanning agents disclosed in U.S. Pat. No. 4,060384 and having a solids content of about 30%. Chromesaver TM A-31 is available from Rohm & Haas. The hide stock is rotated in the drum for about 3 hours. At the end of about a 3-hour rotation, the hide stock should demonstrate 100% penetration with the pretanning liquor, when stained with Alizarine Red indicator.

To the pretanning liquor is added 1.2 to 1.3% (preferably 1.25%) sodium bicarbonate by hide weight; this amount is charged to the drum in fifths for a total of 5 feeds, about 10 minutes apart, after which the drum is rotated for about 30 minutes. A broad spectrum preservative is then added to the pretanning liquid by, for example, adding 0.016% by hide weight of Kathon LP and 0.016% by hide weight water to the pretanning liquor. Kathon LP is a braod spectrum preservative, manufactured by the Rohm & Haas Company, which contains 8.1% active ingredient preservative in a propylene glycol solvent. Kathon LP is exemplary of a number of broad spectrum preservatives known in the art.

The hide stock is then turned for about 30 minutes in the drum, allowed to rest for about 1 hour, and is then—if the surface pH of the stock is about 4.6 and the center pH of the stock is between 4.0 and 4.5—dumped from the drum and stretched over horses overnight. If necessary, the pH ia adjusted with sulfuric acid or sodium bicarbonate, with the necessary rotation and rest period before the hides are drained and stretched.

The pretanning process yields a hide which has a shrinkage temperature between about 170° and 185° F. The stretched hides may be split or shaved at this stage and reweighed or, if the hides were lime split before pretanning, the hides need not be removed from the drum and the process may continue. When pretanning is complete, the present process continues with tanning, the second phase of the invention.

In order to commence tanning, the drum is filled with about 30% by hide weight of 70° F. water. Then 4 to 6% by hide weight sodium chloride solution, preferably 5% by hide weight sodium chloride, is added, to yield a Salimeter reading, after 5 minutes' rotation, between 45 and 50. The pH is then checked and, if it is below the range of 4.0 to 4.5, it is corrected with formic acid. Subsequently, 2% by hide weight Orotan TV is added to the brine. Orotan TV is a liquid phenolic syntan containing 49.0% water, 31.0% tannin and 19.0% soluable non-tannin solids and having a pH of 3.1 when diluted with nine parts water. Orotan TV is available from Rohm & Haas. Other phenolic syntans maybe substituted in tanning equivalent amounts.

In addition to the Orotan TV, 15% by hide weight wattle powder is added to the brine in two feeds, one hour apart. Wattle powder is a vegetable tan having wide availability and is the dried aqueous extract of wattle leaves (Acacia pycnantha). Throughout the addition of the Orotan TV and the wattle powder, the drum is rotated for 2 to 3 hours until the tanning liquor is well penetrated in the hide. The temperature of the tanning liquor should not exceed 100° F. After the hides are well penetrated, additional 70° F. water is added to the drum to fill it to between about 70 to 80% capacity. After rotation proceeds for another 2 hours, the tanning phase is complete. The drum is drained and the hides are stretched over horses overnight, after which they may be shaved to the desired weight.

The third essential phase of the present process is the retanning phase. The retanning phase begins with weighing the hides so that the retanning, coloring and fatliquoring agents may be added in amounts calculated based upon the weight of the hides. The hides are then returned to the rotating drum.

After the drum is filled with an amount of 95° F. water equal to 100% of the weight of the hides, formic acid is added to the drum in the amount of 0.25% by weight of the hides along with 2.5% water by hide weight. The drum is rotated for 30 minutes until the pH is approximately 3. The hides are then washed for 5 minutes in 85° F. water, after which the drum is filled with 85° F. water in the amount of about 70% by hide weight. 10% by hide weight of a mineral tanning agent is added, such as zirconium sulfate, aluminum sulfate, ferric sulfate and the like, and the drum is rotated for 1 hour. Then, 1% by hide weight of sodium acetate is added and the drum is rotated for another hour. At this time the pH should be 2.8 to 3. About 1.75% sodium bicarbonate by hide weight, along with 17.5% water by hide weight, is added in three feeds 15 minutes apart and the drum is rotated another 2½ hours. The pH should be approximately 3.8%. If the pH is under 3.8, additional sodium bicarbonate is added. After the float is drained, the hides are washed with 85° F. water for 10 minutes, At this point, the essential phases of pretanning, tanning and retanning are complete, and the hides demonstrate superior shrink resistance.

Applicants can only speculate as to why the present method yields leather having a "chrome" character whereas other leather processes which incorporte similar tanning agents do not yield leather characteristic of chrome-tanned leather. Applicants believe, however, that the combination and order of addition of the pretanning agents, the sodium chloride, the Orotan TV, the wattle, the formic acid, the mineral sulfate, the sodium acetate and the sodium bicarbonate, along with the required pH control, are respnsible for the ultimate chrome character of the leather. Applicants' belief is based upon the observation that omission of any one of these agents, rearrangements of the order of addition, or aberrations in pH result in inferior leather products. The tanned products according to the present process can, however, withstand immersion in boiling water, for 2 minutes without shrinking, at 212° F. (100° C.).

In a new float of 100° F., dyeing agents may be added to the drum by methods known in the art. After 1 hour, if dye penetration is satisfactory and complete, known fatliquoring and waterproofing agents in the art may be added to the drum. Suitable agents include Densodrin, Hydrofoil 214 and Eupilon, available from BASF Wyandotte, Henkel, Inc., and Stockhausen Bayoil, respectively. when the leather is intended for use as leather should be treated with a special waterproof oil and/or finishing material such as a silicone resin finsih. A resin suitable for use in the invention is the Dow Corning® 478 Fluid (formerly Dow Corning® XT-4-1060 Fluid) which is a water dispersible silicone preparation containing approximately 50% solids. Ten parts of the 478 Fluid are dispersed in 30 parts of 130° F. water, along with one part acetic acid, to yield a 478 Fluid dispersion. The dispersion is used to finish the leather as follows.

After dyeing is complete, the hides are drained and the drum is half filled with fresh 130° F. water. The 478 Fluid dispersion is added in an amount sufficient to yield a suspension containing 5.0% of the 478 Fluid dispersion. The drum is rotated for about 30 minutes, and the finishing suspension is drained from the drum. The hides are removed from the drum without rinsing and stretched over horses overnight.

The tanned leather materials which result from the process described above demonstrate the advantages and properties characteristic of chrome-tanned leather. The leather demonstrates superior resilience, flexural strength, hand and feel as compared with hides tanned by other non-chrome tanning processes. In particular, however, the resultant leather products demonstrate superior shrink resistance, comparable to that of chrome-tanned leather. specifically, hides tanned in accordance with the subject process can withstand immersion in boiling water for 2 minutes, without shrinking.

The invention is further illustrated by reference to the following examples.

EXAMPLE I

Limed, soaked and dehaired hides were bated in a 4×8 foot rotatable wood hide-treating tumbling drum. The bating liquor was drained and the hides were washed for 20 minutes with 80° F. water. The hides were drained. The hides were then covered with water, filling the drum approximately halfway. 3% ammonium sulfate by hide weight was added to the water in the drum together with 0.07% by hide weight Oropon WN-4. The drum was rotated for 5 minutes out of every 15 minutes for 1 hour.

The drum was stopped, the pH of the liquor was observed to be 8.5, and the drum was again rotated for 5 minutes out of every 15 minutes for the next half hour. The hides were washed with 75° F. water and then covered with 75° F. water. To the water were added 1.25% by hide weight Leukotan-1042 and 5% by hide weight sodium chloride. The salimeter read 28. 1.5% sulfuric acid was then added and the drum rotated for 1 hour. The liquor pH was then 2.0 to 2.2. The hide stock was left immersed in the brine admixture overnight.

The following morning, the drum was rotated for 5 minutes. sodium formate was then added to the pretanning liquor in the amount of 0.75% sodium formate by hide weight to yield a pH of 2.7. The hide stock pH registered 2.8.

Sufficient Chromesaver TM A-31 and Busan 30 were added to the drum to accomplish additipons of 3.5% A-31 by hide weight and 0.016% Busan 30 by hide weight. The drum was rotated for 3 hours. Subsequently, 1.25% by hide weight sodium bicarbonate was added to the liquor in a total of five feed over a period of 30 minutes. 0.016% by hide weight Kathon LP also was added to the pretanning liquor and the hide stock was rotated for 30 minutes, allowed to rest for 1 hour, the pH was then 4.3 to 4.6, the stock was drained and stretched over horses for 12 hours. After the 12 hours elapsed, a swatch was cut from the pretanned leather and the swatch was tested in hot water baths of various tempertures. The swatch demonstrated a shrinkage temperature of 175° F.

EXAMPLE 2

Hides prepared in accordance with Example I were charged to the retanning drum and washed with 70° F. water for 10 minutes. The drum was filled with 30% by hide weight water at 70° F. and 5.0% by hide weight sodium chloride. A salimeter reading of the brine registered 40 to 50 and the pH was 4 o 4.5. Subsequently, 2% Orotan TV and 2% dry wattle powder, both calculated by hide weight, were added in sequence to the drum. Rotation of the drum, at 4 to 6 RPM, proceeded for 45 minutes. Then another 13% dry wattle powder was added in two feeds, 1 hour apart, and the drum continued to rotate at 4 to 6 RPM for another 2 hours. The penetration of the wattle into the hides was then checked, found satisfactory, and another addition of 70° F. water was made to the drum in the amount of 50% of total hide weight. The drum was then rotated for an additional 2 hours, after which the pH of the tanning liquor was between 3.8 and 4.0. The hides were drained, stretched and dried, and shaved.

A swatch of hide was cut and tested in a hot water bath; the swatch resisted shrinkage throughout after immersion in a 185° F. minimum waterbath for 3 minutes.

EXAMPLE 3

Hides tanned in accordance with Example 2 were charged to a rotating drum. The water and materials were calculated on the shaved weight of the hides.

Water at 95° F. was added to the drum in an amount equal to the weight of the hides. Formic acid in the amount of 0.25% of total hide weight was then added and the drum was rotated for 30 minutes. The hides were washed for 5 minutes with water at 85° F. and then the drum was drained. After the drum was drained, 70% of the total hide weight of water was added to the drum. Then 10% by hide weight of aluminum sulfate was added, and the drum was rotated for 1 hour. Then 1% by hide weight of sodium acetate was added and the drum was rotated for 30 minutes. The hides were then neutralized with sodium bicarbonate and sodium format to yield a pH of 4.5. This neutralization required approximately 2% sodium bicarbonate and 1% sodium formate added in four feeds, 15 minutes apart, over a 2-hour period of rotation.

The hides were washed for 5 minutes with 85° F. water and 5 minutes with 130° F. water. then the drum was completely drained. subsequently, the hides were dyed and fatliquored by techniques known in the art.

The leather was then treated with Densodrin, Hydrofoil 214 and Eupilon oils. About 6 to 10% of the above oils and 0.2% synthetic Oleum bubulum (or neat's-foot oil) were added, along with the hides, to the drum and were rotated for 1 hour.

Because the oil was not well exhausted after 1 hour, the drum was rotated for an additional 15 minutes, with the addition of 0.5% formic acid.

The drum was drained and refilled with 50% by hide weight of water at 130° F., and 3% Dow Corning 478 Fluid dispersion was added and the drum was rotated for 30 minutes. The hides were dumped from the drum and stretched. a test swatch of the hides resisted shrinkage after immersion in 212° F. (100° C.) water for 2 minutes.

Having presently described the preferred embodiments of this invention, it is to be understood that it may be otherwise embodied within the scope of the appended claims.

I claim:

1. A method for preparing leather from limed hides to yield leather having a "chrome" character without the use of chromium, comprising the steps of:

(1) pretanning a hide with an essentially chromium-free tan until its shrinkage temperature is about 170° to 185° F., and (2) tanning and retanning the pretanned hide by sequentially (a) submerging said pretanned hide in an aqueous solution containing water and about 4 to 6% by hide weight sodium chloride, (b) adjusting the pH of said aqueous solution to between about 4.0 and 4.5, (c) adding liquid phenolic synthetic tanning agents and vegetable tanning agents, (d) draining the hide and adding a mineral tanning agent in an amount calculated as 10% of the total hide weight, along with water calculated as 100% of the total hide weight, (e) adjusting the pH of said aqueous solution to approximately 3.7 to 3.9 to yield a tanned hide, and (f) draining and finishing said tanned hide.

2. The method of claim 1 further comprising limiting step 2 (c) to:

(c) adding liquid phenolic synthetic tanning agnets in the amount by weight of about 2% of the weight of the pretanned hides, and extract of vegetable tanning agents in the amount by weight of about 13 to 15% of the weight of the pretanned hides.

3. The method of claim 2, further comprising limiting step 2 (a) to:

(a) submerging said hide in an aqueous solution containing water and about 5% by hide weight sodium chloride.

4. The method of claim 2, further comprising limiting step 2 (d) to:

(d) adding, in an amount calculated as 10% of the weight of said hide, a compound selected from the group consisting of zirconium sulfate, feric sulfate, and aluminum sulfate.

5. The method of claim 2, further comprising the step of 2 (g):

waterproofing said tanned hide with a waterproofing agent.

6. The method of claim 2, further comprising limiting step 2 (b) to:

(b) adjusting the pH of said aqueous solution, with aqueous formic acid, to between 4.0 and 4.4.

7. The method of claim 2, further comprising limiting step 2 (e) to:

(e) adjustiing the pH of said aqueous solution to approximately 3.7 to 3.9 to yield a tanned hide by adding about 1% by hide weight of sodium acetate and at least about 1.75% by hide weight sodium bicarbonate.

8. The method of claim 2 further comprising limiting step 2 (c) adding liquid phenolic synthetic tanning agents in the amount by weight of 2% of the weight of the pretanned hides, and extract of Acacia pycnantha in the amount by weight of about 13 to 15% of the weight of the pretanned hides.

9. The product prepared in accordance with the process of claim 1.

10. An article of footwear prepared in accordance with the process of claim 2.

* * * * *

UNITED STATES PATENT AND TRADEMARK OFFICE

CERTIFICATE OF CORRECTION

PATENT NO. : 4,740,211

DATED : April 26, 1988

INVENTOR(S) : Marcel Siegler, Ernest Diamont, Joseph L. Suarez and Colin D. Quinn It is certified that error appears in the above-identified patent and that said Letters Patent is hereby corrected as shown below:

Column 8 Line 6 "then" should read --Then--.

Column 8 Line 7 "subsequently" should read --Subsequently--.

Column 8 Line 21 "a" should read --A--.

Column 8 Line 31 after "steps" insert --, in sequence,--.

Column 8 Line 54 "agnets" should read --agents--.

Column 9 Line 1 "feric" should read --ferric--.

Column 9 Line 10 "4.4" should read --4.5--.

Column 10 Line 5 after "2" insert --(c) to:-- and indent for a new paragraph beginning with "(c) adding" etc.

Signed and Sealed this

Twenty-eighth Day of February, 1989

*Attest:*

DONALD J. QUIGG

*Attesting Officer*

*Commissioner of Patents and Trademarks*